United States Patent [19]

van der Loo et al.

[11] 3,994,818

[45] Nov. 30, 1976

[54] SUBSTANTIALLY NON-AQUEOUS LOW FOAMING LIQUID NON-IONIC DETERGENT COMPOSITION

[75] Inventors: Carolus H. van der Loo; Walter J. Rootsaert, both of Amsterdam, Netherlands; Neville E. Jones, Camberly, England

[73] Assignee: Shell Oil Company, Houston, Tex.

[22] Filed: Mar. 4, 1976

[21] Appl. No.: 663,646

[30] Foreign Application Priority Data

Mar. 4, 1975 United Kingdom ..... 8895/75

[52] U.S. Cl. ..... 252/171; 252/89 R; 252/170; 252/321; 252/358; 252/DIG. 1; 252/DIG. 14

[51] Int. Cl.[2] ..... C11D 1/72; C11D 3/20; C11D 3/43; C11D 17/08

[58] Field of Search ..... 252/DIG. 1, DIG. 14, 252/89, 140, 153, 170, 171, 321, 358

[56] References Cited

UNITED STATES PATENTS

| | | | |
|---|---|---|---|
| 3,419,500 | 12/1968 | Rytter | 252/89 |
| 3,472,783 | 10/1969 | Smillie | 252/89 |
| 3,625,909 | 12/1971 | Berg | 252/153 |
| 3,629,122 | 12/1971 | Jakobi | 252/89 |
| 3,630,929 | 12/1971 | van Dijk | 252/136 |
| 3,679,608 | 7/1972 | Aubert | 252/526 |
| 3,736,259 | 5/1973 | Buck | 252/89 |
| 3,812,041 | 5/1974 | Inamorato | 252/89 |
| 3,870,647 | 3/1975 | Travers | 252/118 |
| 3,926,831 | 12/1975 | Sonnengruber | 252/171 |
| 3,928,249 | 12/1975 | Nunziata | 252/526 |
| 3,931,033 | 1/1976 | Lohr | 252/122 |
| 3,933,672 | 1/1976 | Bartolotta | 252/116 |
| 3,948,819 | 4/1976 | Wilde | 252/545 |
| 3,953,351 | 4/1976 | Keller | 252/132 |
| 3,953,380 | 4/1976 | Sundby | 252/543 |
| 3,953,382 | 4/1976 | Nelson | 252/548 |

*Primary Examiner*—Dennis L. Albrecht

[57] ABSTRACT

Detergent compositions comprising: (a) a $C_8$ to $C_{18}$ alcohol ethoxylate containing from 2 to 4 moles of ethylene oxide per mole of alcohol, (b) a $C_7$ to $C_{13}$ alcohol or mixture thereof, (c) a $C_1$ to $C_6$ alcohol or mixture thereof, (d) a defoamer and (e) optionally a $C_8$ to $C_{18}$ alcohol ethoxylate containing from 5 to 9 moles of ethylene oxide per mole of alcohol have good detergency properties with low-foaming characteristics.

8 Claims, No Drawings

SUBSTANTIALLY NON-AQUEOUS LOW FOAMING LIQUID NON-IONIC DETERGENT COMPOSITION

BACKGROUND OF THE INVENTION

1. Field of the Invention

This invention is concerned with detergent compositions comprising alcohols and alcohol ethoxylates.

2. Description of the Prior Art

The present invention relates to detergent compositions, in particular to detergent compositions for use in dishwashing machines, such as automatic dishwashing machines.

Dishwashing machines, in particular institutional large dishwashing machines such as canteen and restaurant dishwashing machines, use liquid or powder cleaning agents based mainly on inorganic salts such as inorganic phosphates and strong alkalies. Examples of such phosphates include trisodium phosphate and tetrasodium pyrophosphate and examples of such strong alkalies include sodium carbonate and sodium silicates.

Such liquids or powders usually have one or more of the following disadvantages:

a. they etch glassware and ceramic units, b. they cause damage of above-glaze decoration on crockery, c. they often do not prevent formation of deposits of calcium and/or magnesium salts on crockery surfaces, which results in dullness thereof; such salts also cause scaling of machine parts, the removal of which requires a considerable maintenance effort; the tendency towards salt formation often necessitates, in many machines, demineralization of the washing water in order to obtain adequate cleaning performance, and d. the phosphates, in particular, which are present in the waste water give rise to environmental problems.

The applicants have now discovered liquid non-ionic detergent compositions which are subsubstantially free of inorganic salts and which are based on certain exthoxylated alcohols and certain alcohols, which overcome one or more of the above objections and which are low-foaming and are good cleaning agents. Such non-ionic detergent compositions may in addition also be used in both the wash and rinse cycle of washing machines i.e. they are good rinse and cleaning aids.

SUMMARY OF THE INVENTION

This invention is based on the discovery that certain combinations of alcohols and alcohol ethoxylates and a defoamer result in detergent products having good detergency properties and low-foaming action and are particularly suitable for use in automatic dishwashing machines.

DESCRIPTION OF THE PREFERRED EMBODIMENTS

The applicants have discovered liquid detergent compositions comprising:

a. a $C_8$ to $C_{18}$ alcohol ethoxylate containing, on average, from 2 to 4 moles of ethylene oxide for each mole of $C_8$ to $C_{18}$ alcohol, b. a $C_7$ to $C_{13}$ alcohol or mixture thereof, c. a $C_1$ to $C_6$ alcohol or mixture thereof, d. a defoamer, and optionally e. a $C_8$ to $C_{18}$ alcohol ethoxylate containing, on average, from 5 to 9 moles of ethylene oxide for each mole of $C_8$ to $C_{18}$ alcohol Products of type (a) are preferably prepared from straightchain alcohols i.e. alcohols comprising more than 70% weight (w) of linear products. The alcohols are preferably saturated, i.e., they are substantially free of olefinic unsaturation and are preferably primary alcohols. A single alcohol may be used e.g. octyl alcohol, decyl alcohol, dodecyl alcohol, but preferably a mixture of alcohols is used. The mixture of alcohols may contain small amounts of alcohols below $C_8$ and above $C_{18}$ but preferably at least 90%w, and more preferably at least 95%w, of the alcohols thereof are in the $C_8$ to $C_{18}$ range. Preferred mixtures of alcohols are those prepared by hydroformylation of olefins. Particularly preferred mixtures of alcohols are those containing $C_{12}$ to $C_{15}$ alcohols wherein at least 95% of the alcohols are in the $C_{12}$ to $C_{15}$ range.

Products of type (a) are preferably prepared by reacting from 2 to 4 moles, suitably 3 moles, of ethylene oxide with 1 mole of the alcohol or alcohol mixture. Such products usually comprise unreacted alcohols in amounts of below about 30%w, usually in the range of from about 10 to about 25%w. Small amounts of polyethylene glycols, for example those having molecular weights in the range 350 to 850, may also be present, usually in amounts of below about 4%w. The presence of unreacted alcohols is not considered harmful to the performance of the detergent compositions and there is no need to strip them off. Such products are obtained using conventional ethoxylation reaction conditions, i.e., temperatures of from 100°–200° C, pressures of from 2 to 7 atmospheres and catalysts such as alkalimetal hydroxides (amount usually below 0.5%w, of product). Preferred products of type (a) are those having hydroxyl numbers of from 135 to 215, particularly from 155 to 175Mg KOH/g. Such products usually have a wide spread of ethoxylate content. It will be understood that aforesaid alcohol (b) is additional alcohol added to these products and not those unreacted alcohols already present in such products. Products of type (a) may also be prepared by blending alcohol ethoxylates containing average ethylene oxide contents below 2 and above 4. Product (a) is present in the detergent composition in amounts of from 60 to 90%, preferably from 70 to 80%w, based on total weight of (a), (b), (c) and (d).

Alcohols of type (b) are preferably straight-chain alcohols, i.e., alcohols comprising more than 70%w, more preferably more than 80%w of linear alcohols. The alcohols are preferably saturated i.e. substantially free of olefinic unsaturation and are preferably primary alcohols. A single alcohol may be used e.g. octyl alcohol decyl alcohol, dodecyl alcohol, but preferably a mixture of alcohols is used. The mixture of alcohols may contain small amounts of alcohols below $C_7$ and above $C_{13}$ but at least 90%w, and preferably at least 95%w, of the alcohols thereof are in the $C_7$ to $C_{13}$ range. Preferred mixtures of alcohols are those mixtures of $C_9$ to $C_{11}$ alcohols such as those prepared by hydroformylation of olefins. Alcohol (b) is present in the detergent compositions in amounts of from 10 to 30%w, preferably from 15 to 25%w, based on total weight of (a), (b), (c) and (d).

The preferred alcohol of type (c) is isopropyl alcohol but other $C_1$–$C_6$ alcohols such as ethanol, n-propanol, butanol may be used as well as mixtures thereof. Alcohol (c) is present in the detergent compositions in amounts of from 2 to 9%w, preferably from 4 to 8%w, based on total weight of (a), (b), (c) and (d).

The defoamer (d), i.e., a compound which inhibits foam formation, is of the silicone-oil type, such as a poly(alkyl)siloxane. Suitable poly(alkyl)siloxanes are poly(dimethyl)siloxanes. They may be represented by the following general formula

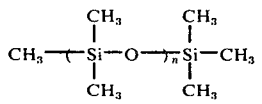

wherein $n$ is an integer. Suitable defoamers have molecular weights in the range of from 2,500 to 7,500. Such defoamers are usually available commercially in the form of aqueous emulsions containing say from 10 to 50%w of active matter (a.m.). It is possible to use the aqueous emulsion as such since the small amounts of water present therein are not harmful to the stability of the detergent compositions. Suitably, the emulsions have viscosities of from 100 to 500, preferably from 200 to 400 centistokes at 25° C. The defoamer (d) is present in the detergent composition in amounts of at least 0.05%w and usually in amounts of less than 2.0%w, based on total weight of (a), (b), (c) and (d). Amounts below 1.0%w are satisfactory. These percentages, in the case of an aqueous emulsion, refers to the active matter content thereof.

The detergent compositions may be described as being substantially free of water which means that no water is added to the formulation other than that which is already present in the components thereof. However, if the water content exceeds 5%w then usually phase separation of the composition occurs.

An optional component of the formulation is a $C_8$ to $C_{18}$ alcohol ethoxylate containing, on average, from 5 to 9 moles of ethylene oxide for each mole of $C_9$ to $C_{18}$ alcohol (product (e)), preferably obtained by reacting from 5 to 9 moles of ethylene oxide with 1 mole of a $C_8$ to $C_{18}$ alcohol or mixtures thereof, preferably a mixture of $C_9$ to $C_{11}$ alcohols. Suitable alcohols are those described above for the alcohol of type (b). Preferably such products are obtained by reacting about 6 moles of ethylene oxide with 1 mole of the alcohol or alcohol mixture. Unlike aforesaid product (a) such products do not usually contain large amounts of unreacted alcohols. The amount of unreacted alcohol is usually less than 5%w. It will again be understood that aforesaid alcohol (b) is additional alcohol and not that unreacted alcohol present in these products. Such products are also obtained by the conventional ethoxylation reaction conditions as described above. Suitable products have hydroxyl numbers of from 100 to 150, preferably of from 12 to 140 mg. KOH/g. Product (e) is present in the detergent compositions in amounts of from 10 to 30%w, preferably 15 to 25%w, based on total weight of (a), (b), (c) and (d).

Preferred compositions of the invention are nonionic, substantially water-free compositions, comprising a. from 60 to 90%w of a $C_{12}$ to $C_{15}$ alcohol ethoxylate prepared by reacting from 2 to 4 moles of ethylene oxide with 1 mole of a mixture of $C_{12}$ to $C_{15}$ alcohols, b. from 10 to 30%w of a mixture of $C_9$ to $C_{11}$ alcohols, c. from 2 to 9%w of a $C_1$ to $C_6$ alcohol, d. from 0.05 to 2.0%w of a silicone-oil defoamer, and optionally e. from 10 to 30%w of a $C_8$ to $C_{18}$ alcohol ethoxylate prepared by reacting from 5 to 9 moles of ethylene oxide with 1 mole of a mixture of $C_8$ to $C_{18}$ alcohols, the percentages being based on total weight of (a), (b), (c) and (d).

The composition may comprise other conventional detergent components such as perfumes, dyes, germicides, perservatives etc.

As stated above the detergent compositions of the present invention are particularly suitable for use in automatic dishwashing machines. The compositions are harmless to glassware, ceramic units and crockery; they deposit only small amounts, if any, of calcium or magnesium salts, and may be used with ordinary, i.e. non-demineralized, water; they are environmentally harmless and/or are substantially biodegradable. They also possess the advantages of being substantially water-free; that they are good cleaning aids and form only acceptable amounts of foam in the dishwashing machines. They also may be used in both the rinse and wash cycles of washing machines. The compositions, particularly when containing product (e) are very suitable for use in one-stage injecting i.e. a single injection into the rinse cycle, the water of which, after rinsing, overflows into the wash cycle. The products also have the advantage that they have low clear points, usually below 8° C.

The invention is further described by the following examples and illustrative embodiments which are provided for illlustration and are not to be construed as limiting the invention.

EXAMPLES

In the examples the following products were used.

1. $C_{12}$ to $C_{15}$ alcohol/3 EO product.

This product was prepared by reacting about 3 moles of ethylene oxide with about 1 mole of a mixture of primary $C_{12}$ to $C_{15}$ hydroformylation alcohols. The alcohols comprised 18–24%w of $C_{12}$ alcohols, 26–32%w of $C_{13}$ alcohols, 26–32%w of $C_{14}$ alcohols and 18–24%w of $C_{15}$ alcohols; less than about 3%w of other alcohols were present. The alcohols comprised about 75%w of linear alcohols.

The ethoxylation product comprises about 14 to 18%w of unreacted alcohols and about 0.2 to 0.6%w of polyethylene glycol (average molecular weight about 500–620). It has a hydroxyl number of about 160 to 172 mg KOH/g.

2. $C_9$–$C_{11}$ alcohol.

This product was prepared by hydroformylation. The alcohols are primary and comprise 15–25%w of $C_9$ alcohols, 45–55%w of $C_{10}$ alcohols and 25–35%w of $C_{11}$ alcohols, less than about 3%w of other alcohols are present. It also comprises about 90%w of linear alcohols.

3. Defoamer.

This product is a poly(dimethyl)siloxane type defoamer having an average molecular weight of aobut 5,000. It was used as a 20%w active matter aqueous emulsion having a viscosity of about 300 centistokes at 25° C.

4. $C_9$ to $C_{11}$ alcohol/6 EO product.

This product was prepared by reacting about 6 moles of ethylene oxide with about 1 mole of the mixture of primary $C_9$ to $C_{11}$ hydroformulation alcohols as described under 2.

The ethoxylation product comprised less than about 3%w of unreacted alcohols. It has a hydroxyl number of about 126–140 mg KOH/g.

The detergent compositions of the Examples were tested in various automatic dishwashing machines including the types "DIVERSY" and "MEIKO" (model BA 250 v). The products were used in both the rinse and wash cycles at concentrations of about 0.1–0.2 (spray rinse), 0.2–0.6 (rinse plus wash), ml/1 in the "Diversey" machine and at concentrations of about 0.1–0.2 (spray rinse), 0.5–0.7 (wash) ml/1 in the "MEIKO" machine.

The products were evaluated principally for their cleaning performance in both the rinse and wash cycles and for the amount of foam they produced. After the wash and rinse cycles the plates and cutlery were examined to determine whether they had become smeared and to determine whether fat, lipstick and egg stains were satisfactorily removed.

EXAMPLES I to III

Detergent compositions were prepared by mixing the components in the amounts indicated in Table I. All compositions performed satisfactory as rinse and as wash aids although the compositions of Examples II and III performed better than the composition of Example I insofar as their ability to remove fat, lipstick and egg stains were concerned as well as their ability to prevent smearing of the plates ad cutlery.

All compositions did not produce unacceptable amounts of foam in the wash cycle. This good property of the compositions was confirmed by a laboratory test which comprised placing, at 20° C, 75 mg of the composition and 50 ml of the water in a 100 ml measuring cylinder. The cylinder was then shook vigorously 20 times and the height of foam formed observed after 30 seconds and 5 minutes. In all cases the height of foam was below 1 ml after 30 seconds and had disappeared by 5 minutes.

Table I

| Component | % w based on total composition | | | % w, based on (a)+(b)+(c)+(d) | | |
|---|---|---|---|---|---|---|
| | Ex. I | Ex. II | Ex. III | Ex. I | Ex. II | Ex. III |
| (a) $C_{12-15}$alcohol/3 EO | 74 | 61.8 | 59.6 | 74.8 | 74.9 | 72.2 |
| (b) $C_{9-11}$alcohol | 19.8 | 16.5 | 16.5 | 20.0 | 20.0 | 20.0 |
| (c) IPA | 5.0 | 4.0 | 6.0 | 5.0 | 4.85 | 7.3 |
| (d) Defoamer (a.m.) | 0.2 | 0.2 | 0.4 | 0.2 | 0.25 | 0.5 |
| (c) $C_{9-11}$alcohol/6 EO | — | 16.5 | 16.5 | — | 20.0 | 20.0 |
| (f) perfume | 1 | 1 | 1 | 1 | 1.2 | 1.2 |

EXAMPLES IV AND V

Detergent compositions were prepared by mixing the components in the amounts as indicated in Table II. All compositions performed as well as the compositions described in Examples I to III, although they tended to produce more foam. This finding was confirmed by the laboratory test described in Examples I to III in which the compositions of both Example IV and Example V produced 400% more foam after 30 seconds than the compositions of Examples I to III and it was also found that if the amount of defoamer in the composition was increased by 200 %w then these compositions still produced a lot more foam than the compositions of Examples I to III.

Table II

| Component | % w based on total composition | | % w based on (a)+(b)+(c)+(d) | |
|---|---|---|---|---|
| | Ex. IV | Ex. V | Ex. IV | Ex. V |
| $C_{12-15}$alcohol/3 EO | 72.8 | 66.3 | 81.9 | 80.4 |
| $C_{9-11}$alcohol | 10.0 | 10.0 | 11.2 | 12.1 |
| IPA | 6.0 | 6.0 | 6.7 | 7.3 |
| Defoamer (a.m.) | 0.2 | 0.2 | 0.2 | 0.2 |
| $C_{9-11}$alcohol/6 EO | 10.0 | 16.5 | 11.2 | 20.0 |
| perfume | 1.0 | 1.0 | 1.2 | 1.2 |

EXANPLE VI

A detergent composition was prepared by mixing together the following components.

$C_{12-15}$ alcohol/3 EO (75 %w), $C_{9-11}$ alcohol (20 %w), IPA (5 %w). The composition produced an unacceptable amount of foam in the dishwashing machine. This finding was confirmed by the laboratory test described in Example I in which 700% more foam was produced after 30 seconds than for the compositions of Examples I to III. Moreover about 50% of this foam was still present after 5 minutes.

EXAMPLES VII TO IX

Examples I to III were repeated but the $C_{9-11}$ alcohol was replaced by the $C_{12-15}$ alcohol used to prepare the $C_{12-15}$ alcohol/3 EO product. The compositions produced unacceptable amounts of foam.

EXAMPLE X

A detergent composition was prepared by mixing together the following components. $C_{12-15}$ alcohol/3 EO (78.8 %w), $C_{9-11}$ alcohol/6 EO (15 %w), IPA (6.0 %w) and defoamer (0.2 %w a.m.). The composition produced an unacceptable amount of foam.

We claim as our invention:

1. A liquid detergent suitable for use in automatic dishwashing machines and having less than 5 percent by weight of water comprising:

a. from about 60 to about 90% by weight based on total weight of components (a), (b), (c) and (d) of a $C_8$ to $C_{18}$ alcohol ethoxylate containing, on average, from about 2 to about 4 moles of ethylene oxide for each mole of $C_8$ to $C_{18}$ alcohol, b. from about 10 to about 10 to about 30 % by weight based on total weight of components (a), (b), (c) and (d) of a $C_7$ to $C_{13}$ alcohol or mixture thereof, c. from about 2 to about 9 % by weight based on total weight of components (a), (b), (c) and (d) of a $C_1$ to $C_6$ alcohol or mixture thereof, and d. from about 0.05 to about 2% by weight of a poly-(alkyl) siloxane type defoamer.

2. The composition of claim 1 wherein component (a) is a $C_{12}$ to $C_{15}$ alcohol ethoxylate and ranges from about 70 to about 80 % by weight, component (b) is a $C_9$ to $C_{11}$ alcohol and ranges from about 15 to about 25 % by weight, component (c) ranges from about 4 to about 8 % by weight and component (d) ranges from about 0.05 to about 1 % by weight.

3. The composition of claim 2 wherein component (c) is isopropyl-alcohol.

4. The composition of claim 2 wherein component (d) is a poly(dimethyl)siloxane type deformer.

5. The composition of claim 1 which contains as an additional component from about 10 to about 30 % by weight based on total weight of components (a), (b), (c) and (d) of a $C_8$ to $C_{18}$ alcohol ethoxylate containing, on average, from about 5 to about 9 moles of ethylene oxide for each mole of $C_8$ to $C_{18}$ alcohol.

6. The composition of claim 2 which contains as an additional component from about 15 to about 25 % by weight based on total weight of components (a), (b), (c) and (d) of a $C_9$ to $C_{11}$ alcohol ethoxylate containing, on average, from about 5 to about 9 moles of ethylene oxide for each mole of $C_9$ to $C_{11}$ alcohol.

7. The composition of claim 6 wherein component (c) is isopropyl alcohol.

8. The composition of claim 6 wherein component (d) is a poly(dimethyl) siloxane type defoamer.

* * * * *